US006155847A

United States Patent [19]

Wright

[11] Patent Number: 6,155,847

[45] **Date of Patent: *Dec. 5, 2000**

[54] GROUNDING DEVICE

[75] Inventor: John O. Wright, York, Pa.

[73] Assignee: Osram Sylvania Inc., Danvers, Mass.

[ * ] Notice: This patent is subject to a terminal disclaimer.

[21] Appl. No.: 08/863,849

[22] Filed: May 27, 1997

[51] Int. Cl.[7] ..... H01R 4/66

[52] U.S. Cl. ..... 439/98; 439/394; 174/40 CC

[58] Field of Search ..... 439/98, 394, 390, 439/391, 610, 434; 174/40 CC, 51

[56] References Cited

U.S. PATENT DOCUMENTS

| | | | |
|---|---|---|---|
| 4,701,001 | 10/1987 | Verhoeven | 439/394 |
| 4,919,622 | 4/1990 | Suffi | 439/391 |
| 4,973,258 | 11/1990 | Fusselman | 439/98 |
| 5,131,863 | 7/1992 | Gerke et al. | 439/391 |
| 5,777,263 | 7/1998 | Maehler et al. | 174/51 |
| 5,864,090 | 1/1999 | Wright | 174/40 CC |

*Primary Examiner*—Paula Bradley
*Assistant Examiner*—Katrina Davis
*Attorney, Agent, or Firm*—William H. McNeill

[57] ABSTRACT

A grounding device is provided for use with an electrical connector such as an antenna connector. The grounding device includes a forked member which may be inserted through a slot into an insulative connector body to (a) pierce the jacket of a coaxial cable positioned within the connector body and (b) thereby engage the ground wire braid of the cable. The forked member may be integral with a conductive connector shell into which the insulative connector body is inserted.

19 Claims, 3 Drawing Sheets

GROUNDING DEVICE

TECHNICAL FIELD

The present invention relates to a grounding device for use with a coaxial cable. More particularly, the present invention relates to such a grounding device which is useful, without limitation, with conventional antenna connectors such as those used in the automobile industry for radios.

BACKGROUND ART

In many applications involving the use of a coaxial cable it is known to strip one or both ends of the cable to expose a length of the center conductor. Typically, a length of ground wire braid is then folded back upon the cable. In some instances, a metal sleeve is crimped to the outer peripheral PVC surface of the coaxial cable adjacent the stripped end and the ground wire braid is folded back upon such metal sleeve. A metal shell may also be provided adjacent the stripped end, the ground wire braid being sandwiched between the metal sleeve and the metal shell. Processing a coaxial cable in this manner is time consuming and adds to the cost of preparing a coaxial cable for its intended use. Cables dressed in this manner are used, for example, with conventional antenna connectors such as those used in the automobile industry for radios. In such uses, each end of a coaxial cable prepared in this manner may have a respective connector such as a male or female connector mechanically and electrically attached thereto. It is known that if the ground wire braid is not dressed properly there may be a tendency for shorting between the ground wire braid and the center conductor if any portion of the ground wire braid is too close to the center conductor even though not in contact with the center conductor. Such shorting may occur immediately during use of the antenna cable or be intermittent in nature and occur sometime in the future.

It is known to test a coaxial cable for shorts by subjecting the cable to a low voltage. In such test, if the ground wire braid is actually in contact with the center conductor to thereby cause a short, an audible and/or visual indicator will be actuated in response thereto and the faulty coaxial cable may be discarded. In order to test for any shorts which may occur due to the fact that the ground wire braid is too close to, but not in contact with, the center conductor, the cable is mechanically manipulated. In particular, the cable is actually wiggled in an attempt to induce a short by bringing the ground wire braid into contact with the center conductor. This is a time consuming process and in fact, may not be successful in identifying a short-prone cable.

In conventional applications, a typical male or female electrical connector will include a grounding member connected to a conductive connector shell which may be connected to an insulative connector body. In such applications, some means is provided to secure the connector body to the cable, and such means is usually independent of the grounding member. The securing of the connector body to the coaxial cable may require an extra step and additional structural means.

DISCLOSURE OF THE INVENTION

It is an object of the present invention to provide an improved grounding device for use with a coaxial cable.

It is yet another object of the present invention to provide an improved grounding device which can be attached to the end of a coaxial cable to conductively engage the cable ground wire braid without the need to dress the end of the cable to expose a length of ground wire braid.

It is a further object of the present invention to provide an improved grounding device which does not require testing for shorts caused by the ground wire braid.

It is another object of the present invention to provide an improved grounding device for use with an antenna cable.

Yet another object of the present invention is to provide an improved grounding device which is less costly than those fabricated heretofore.

Another object of the present invention is to eliminate any additional step and structure required to attach a coaxial cable to a connector body of an electrical connector, using the improved grounding device of the present invention to secure the cable to the connector body.

This invention achieves these and other objects by providing a grounding device having at least one portion adapted for engagement with a ground wire braid of a coaxial cable. The grounding device comprises at least one forked member which includes a base portion. A first leg extends from the base portion to a first distal end, and a second leg extends from the base portion to a second distal end. The first leg includes a ground wire braid engaging first segment, and the second leg includes a ground wire braid engaging second segment facing the first segment. The fork member may comprise a flange portion which is integral with a conductive connector shell for use with an electrical connector.

BRIEF DESCRIPTION OF THE DRAWINGS

This invention may be clearly understood by reference to the attached drawings wherein like parts are designated by like reference numerals and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
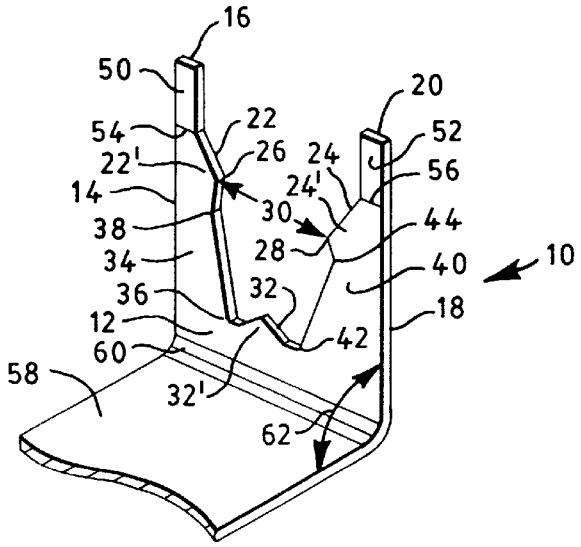
FIG. 1 is a perspective view of a forked member of the grounding device embodying the present invention.

The embodiment of this invention which is illustrated in the drawings is one which is particularly suited for achieving the objects of this invention. FIG. 1 depicts a grounding device having at least one portion adapted for engagement with a ground wire braid of a coaxial cable as described herein. Such grounding device comprises a forked member 10 which includes a base portion 12. A first leg 14 extends away from base portion 12 to a first distal end 16. A second leg 18 extends away from base portion 12 to a second distal end 20. Leg 14 comprises a ground wire braid engaging segment 22, and leg 18 comprises a ground wire braid engaging segment 24 facing the segment 22. At least a portion of the segment 22 is spaced from at least a portion of the segment 24 a first distance which is no greater than an outer diameter of the ground wire braid. For example, in the embodiment of FIG. 1, a portion 26 of segment 22 is spaced from a portion 28 of segment 24 a distance 30. The relationship between distance 30 and the outer diameter of the ground wire braid will be discussed in more detail hereinafter.

In the embodiment illustrated in FIG. 1, the segment 22 is in the form of a first projection 22' which extends towards the segment 24, and the segment 24 is in the form of a second projection 24' which extends towards the first projection 22'. As illustrated in FIG. 1, the first projection 22', formed by segment 22, comprises the first portion 26, and the second projection 24', formed by segment 24, comprises the second portion 28.

In the embodiment illustrated in FIG. 1, the first portion 26 is aligned along an axis with the second portion 28. Such axis coincides with and is therefore represented by the distance arrow 30. The base portion 12 comprises a ground wire engaging third segment 32. The third segment 32 is in the form of a third projection 32' which extends towards the axis represented by distance arrow 30. In the embodiment of FIG. 1, the projections 22',24' and 32' have a triangular shape, the apex of each respective triangular projection 22' and 24' providing the first and second portions 26 and 28, respectively.

Figure 3:
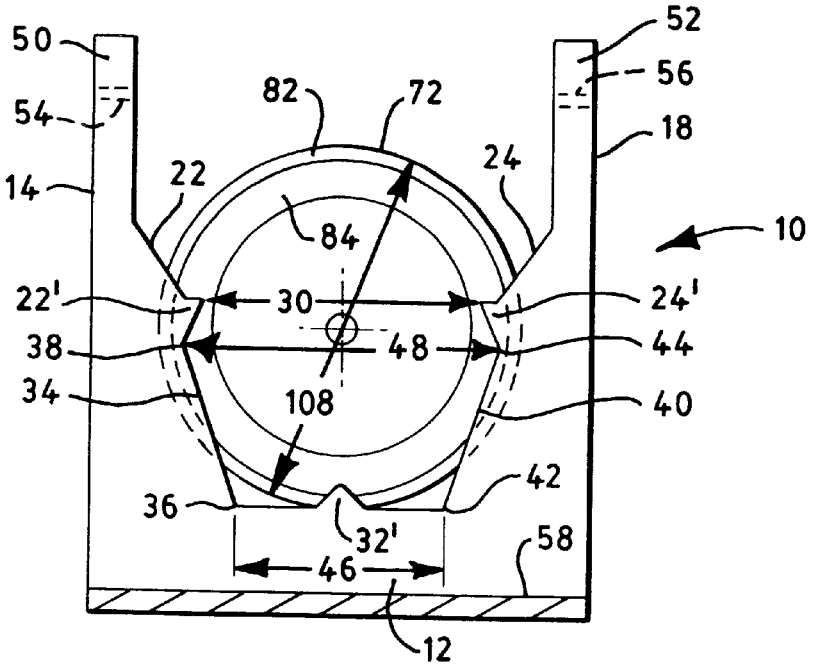
FIG. 3 is a view of FIG. 2 taken along the lines 3—3 depicting the forked member engaging the ground wire braid of the coaxial cable, the insulative connector being deleted for clarity.

In the embodiment illustrated in FIG. 1, the first leg 14 includes a first length 34 which extends from a base junction 36 to a segment junction 38. Similarly, the second leg 18 includes a second length 40 which extends from a base junction 42 to a segment junction 44. With reference to FIG. 3, the distance 46 between the base junction 36 and the base junction 42 is less than the distance 48 between the segment junction 38 and the segment junction 44. The relationship between distances 46 and 48 will be discussed in more detail hereinafter.

In the embodiment illustrated in FIG. 1, the first leg 14 comprises a tab 50 which extends from the first distal end 16 towards the first segment 22. Similarly, the second leg 18 comprises a tab 52 which extends from the second distal end 20 towards the second segment 24. Tabs 50 and 52 arc bendable along respective fold lines 54 and 56 as described hereinafter.

Figure 2:
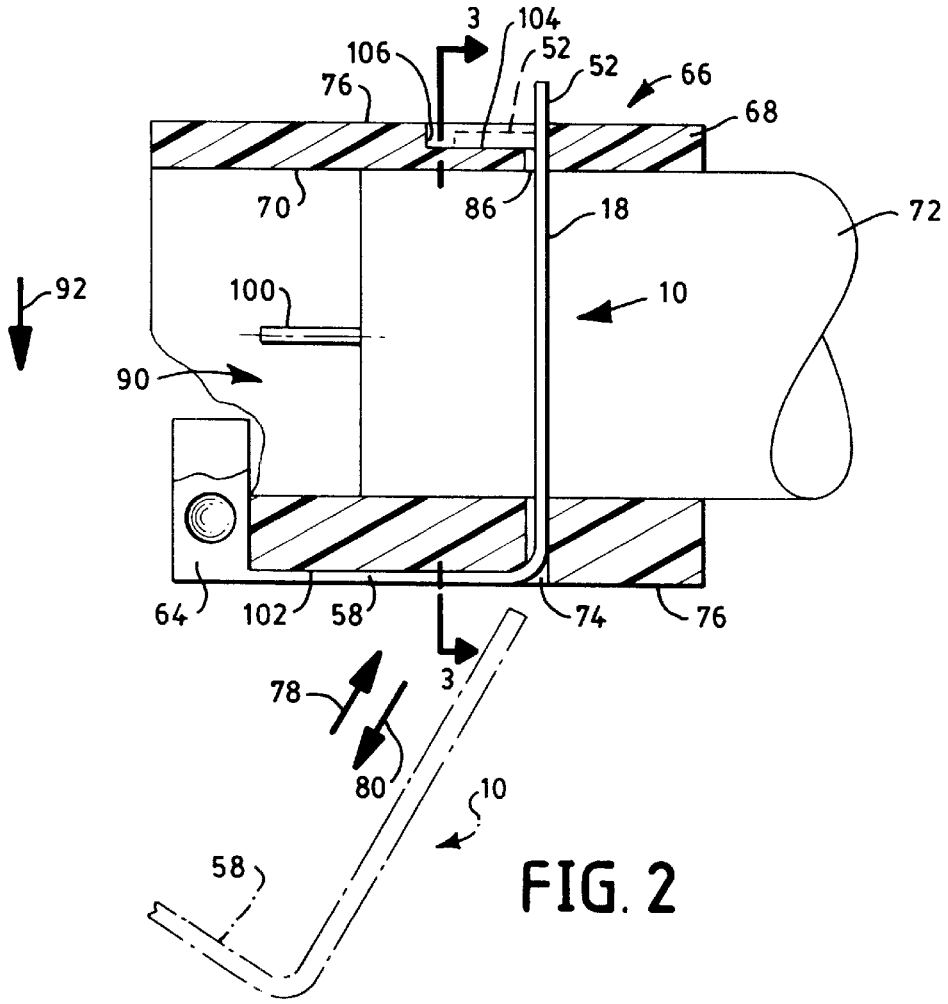
FIG. 2 is an elevational view, partially cross-sectioned, of the forked member of FIG. 1, in combination with an insulative connector and conductive connector shell embodying the present invention, and a coaxial cable inserted therein.

In the embodiment illustrated in FIG. 1, the forked member 10 includes a flange portion 58 which extends from the base portion 12 at fold line 60. Flange portion 58 extends from the forked member 10 at an angle 62 which may be, without limitation, 90°. Flange portion 58 may be integral with a conductive connector shell of the type, for example, used with a conventional male or female electrical connector. Such a conductive connector shell is depicted in FIG. 2. In particular, FIG. 2 depicts the flange portion 58 integral with a conductive connector shell 64. By "integral" is meant that the flange portion 58 and the conductive connector shell 64 are formed as a single piece of material, or that the flange portion is attached to the conductive connector shell.

The grounding device of the present invention may also include an insulative connector. For example, in the embodiment depicted in FIG. 2, the grounding device includes an insulative connector 66 which comprises a connector body, such as a plastic connector body 68, and a bore 70 extending through the connector body. The bore is formed to receive a coaxial cable inserted therein. Typically, bore 70 will be a cylindrical bore having an inner diameter equal to or slightly less than the outer diameter of the coaxial cable 72 so that the coaxial cable fits snugly in the bore. The connector body 68 includes a first slot 74 which extends from an outer surface 76 of the connector body to the bore 70. In the embodiment illustrated in FIG. 2, the forked member 10 and the connector body 68 form slidably engaging portions wherein the forked member may be slid relative to two positions with respect to the connector body. In the first position, the legs 14,18 of the forked member 10 may be moved in the general direction of arrow 78 and inserted into slot 74 and bore 70 as depicted in solid lines in FIG. 2. In the second position, the legs 14,18 of the forked member 10 may be moved in the general direction of arrow 80 and withdrawn from slot 74 and bore 70 as depicted in phantom lines in FIG. 2.

When the forked member 10 is in the first position, the first segment 22 and the second segment 24, will penetrate the jacket 82 of the coaxial cable 72 and engage the ground wire braid 84 of the coaxial cable as illustrated in FIG. 3 and as described in more detail hereinafter.

In the embodiment illustrated in FIG. 2, the connector body 68 includes a second slot 86 which extends from the outer surface 76 of the connector body to the bore 70. Slot 86 is aligned with slot 74.

Figure 5:
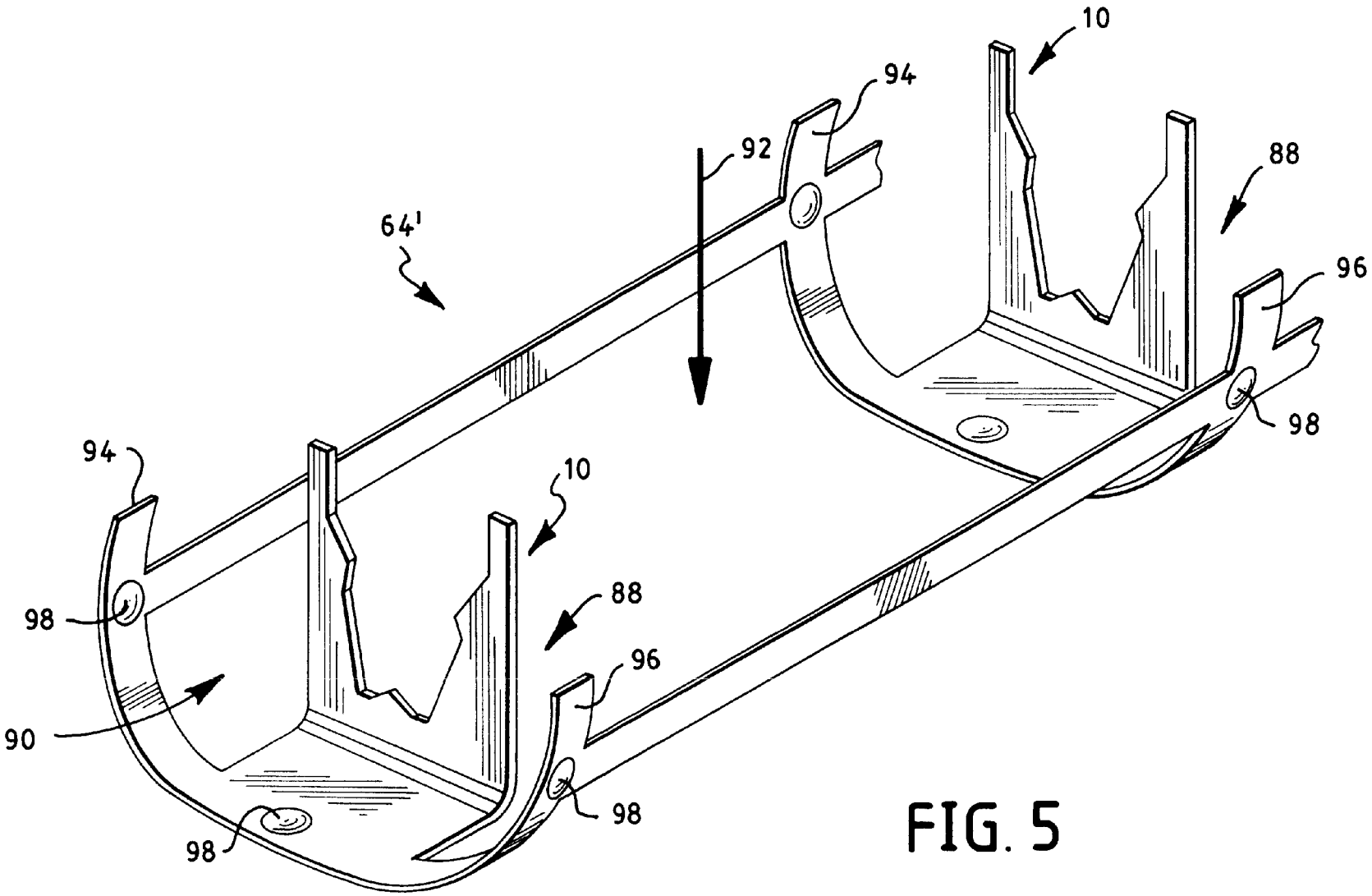
FIG. 5 is a perspective view of a conductive connector shell illustrating one embodiment of the present invention.

In the embodiment illustrated in FIG. 2, the conductive connector shell 64 includes a single forked member 10. The flange portion 58 of the forked member 10 is integral with the connector shell 64, the forked member and the connector shell being formed as a single piece of resilient conductive material. Additional forked members 10 may be provided, if desired, to provide grounding redundancy. For example, in the embodiment illustrated in FIG. 5, a conductive connector shell 64' is illustrated which is identical to the connector shell 64 of FIG. 2 with the exception that connector shell 64' includes at least two forked members and may have a greater length than connector shell 64 to accommodate such additional forked member(s).

The connector shells 64, 64' are each generally in the shape of a cylindrical shell having an open area at 88. By fabricating the connector shells 64, 64' from a resilient conductive material, it is possible to insert the insulative connector body 68 into the cavity 90 of the connector shell. To this end, the connector body 68, which may be in the shape of a cylinder, may be inserted into cavity 90 by urging the connector body in the direction 92, depicted in FIG. 5, thereby causing the portions 94,96 of the connector shell 64' to expand away from each other due to the resiliency of the material until the connector body is fully positioned within cavity 90 and thereby mated with the connector shell. The connector shell may be provided with typical detents 98 which facilitate use of the grounding device of the present invention with a male and female connector in a conventional manner.

Figure 4:
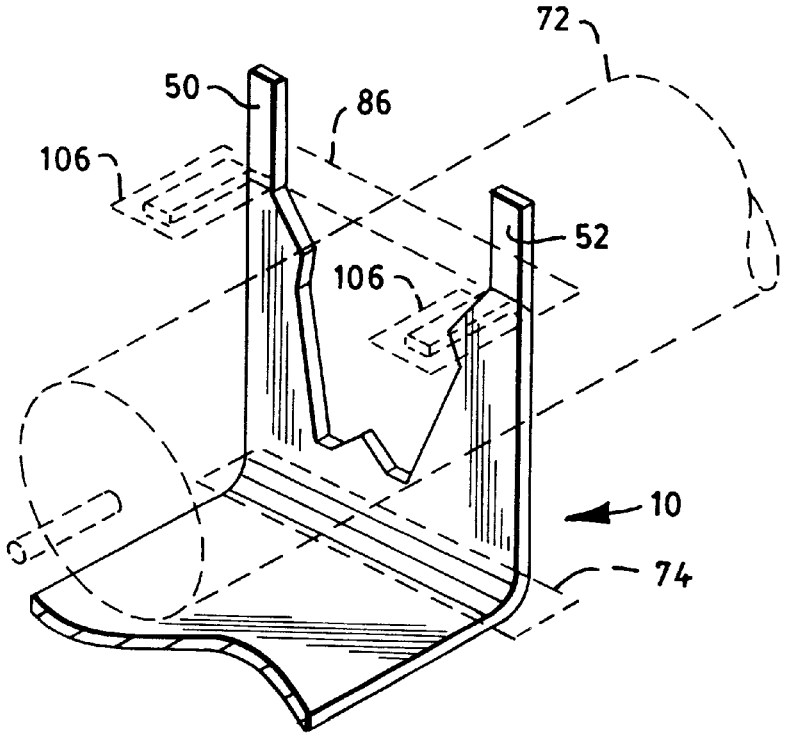
FIG. 4 is a diagrammatic schematic perspective partial view of the embodiment of FIG. 2.

In assembling the grounding device of the present invention as illustrated in FIG. 2, coaxial cable 72 is inserted into the bore 70 of the insulative connector body 68 such that the center conductor 100 of the coaxial cable is positioned for electrical and mechanical connection to a male or female contact in a conventional manner. The conductive connector shell 64 is then attached to the insulative connector body 68 by urging the connector body 68 in the direction 92 until the connector body essentially pops into the cavity 90. During the insertion of the connector body 68 into cavity 90, the fingers 14, 18 of the forked member 10 should be aligned with the slot 74 such that during such insertion the fingers will be inserted into slot 74 and into the bore 70. The insertion of the connector body 68 into the cavity 90 will continue until (a) the tabs 50,52 of fingers 14,18 extend out of the bore 70 and out of the slot 86, as depicted with respect to tab 52 in solid lines in FIG. 2, and (b) the flange portion 58 of the forked member 10 engages an area 102 of the outer surface 76 of the connector body. When in this position, the tabs 50,52 may be folded along fold lines 54,56 against another area 104 of the outer surface 76, as depicted for tab 52 in phantom lines in FIG. 2, to lock the connector body 68 between the flange portion 58 and the tabs 50,52, thereby affixing the connector shell 64 to the connector body. Recesses may be provided to accommodate the folded tabs 50,52. For example, FIG. 2 illustrates a recess 106 into which tab 52 is folded. A similar recess may be provided for tab 50. FIG. 4 schematically illustrates the relationship between cable 72, forked member 10, slots 74 and 86, recesses 106, and tabs 50,52, the tabs shown before being folded (solid lines) and after being folded (phantom lines).

FIG. 3 depicts the outer diameter 108 of the ground wire braid 84 of the coaxial cable 72. In the embodiment of FIG. 3, the interrelationship between the outer diameter 108 and the distance 30 between portions 26 and 28 is such that the distance 30 will be no greater than outer diameter 108. In this embodiment, when such condition is met, at least a portion of the forked member will engage the ground wire braid and effect grounding. In the embodiment illustrated in FIG. 3, the distance 30 is less than the diameter 108 a sufficient amount to assure that when assembled the first segment 22 and second segment 24 are sufficiently embedded within the ground wire braid 84 to effect a very satisfactory grounding. In the embodiment of FIG. 3, such embedding is further effected as a result of the configuration of the legs 14 and 18. In considering the configuration of legs 14 and 18, the distance 46 is less than the distance 48, the result being that the first length 34 of leg 14 and the second length 40 of leg 18 extend away from each other as they extend away from base portion 12 to thereby provide opposing wedging surfaces which bear against and cut through the jacket 82 of the coaxial cable 72 and engage the ground wire braid 84 as the forked member 10 is inserted into slot 74 and base 70 as described herein. During such insertion, the jacket 82 is also cut and penetrated by the projections 22',24' of the first segment 22 and the second segment 24, respectively, and the projection 32' of the third segment 32. The penetration of the jacket 82 of the coaxial cable 72, in combination with the folding of the tabs 50 and 52 of the legs 14 and 18, serve to attach the coaxial cable to the connector body 68.

Fabrication of the various components described herein may be accomplished using conventional procedures. For example, the insulative connector body may be molded from a plastic material. The conductive forked member and connector shell may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A grounding device having at least one portion adapted for engagement with a ground wire braid of a coaxial cable, said grounding device comprising at least one forked member comprising a base portion, a first leg extending from said base portion to a first distal end and a second leg extending from said base portion to a second distal end, said first leg having a ground wire braid engaging first segment and said second leg having a ground wire braid engaging second segment facing said first segment, said first leg further comprising one tab which extends from said first distal end towards said first segment, and said second leg further comprising another tab which extends from said second distal end towards said second segment, said tabs being separated from said legs by fold lines.

2. The grounding device of claim 1 wherein said first segment comprises a first projection extending towards said second segment, and further wherein said second segment comprises a second projection extending towards said first projection.

3. The grounding device of claim 2 wherein said base portion comprises a ground wire braid engaging third segment.

4. The grounding device of claim 3 wherein said first segment includes a first portion, and said second segment includes a second portion, said first portion being aligned along an axis with said second portion, and further wherein said third segment comprises a third projection which extends towards said axis.

5. The grounding device of claim 1 wherein said first leg includes a first length which extends from one first base junction to one first segment junction, and said second leg includes a second length which extends from one second base junction to one second segment junction, a first distance between said one first base junction and said one second base junction being less than a second distance between said one first segment junction and said one second segment junction.

6. The grounding device of claim 5 wherein said first leg comprises one tab which extends from said first distal end towards said first segment, and said second leg comprises another tab which extends from said second distal end towards said second segment.

7. The grounding device of claim 1 wherein said forked member comprises a flange portion extending from said base portion.

8. The grounding device of claim 7 wherein said flange portion is integral with a conductive connector shell.

9. The grounding device of claim 6 wherein said forked member comprises a flange portion extending from said base portion.

10. The grounding device of claim 9 wherein said flange portion is integral with a conductor connector shell.

11. The grounding device of claim 1 further including an insulative connector which comprises a connector body and a bore extending through said connector body, said bore being formed to receive said coaxial cable inserted into said bore, said connector body comprising a first slot which extends from an outer surface of said connector body to said bore, said forked member and said connector body forming slidably engaging portions, said forked member having two positions with respect to said connector body, a first position wherein said forked member is inserted into said slot and into said bore, and a second position wherein said forked member is not inserted into said bore and said slot, and in said first position, said first segment and said second segment being adapted to penetrate a jacket of said coaxial cable positioned in said bore and engaging said ground wire braid of said coaxial cable.

12. The grounding device of claim 11 wherein said first leg includes a first length which extends from one first base junction to one first segment junction, and said second leg includes a second length which extends from one second base junction to one second segment junction, a first distance between said one first base junction and said one second base junction being less than a second distance between said one first segment junction and said one second segment junction.

13. The grounding device of claim 11 wherein said forked member comprises a flange portion extending from said base portion, and wherein said connector body comprises a second slot which extends from said outer surface of said connector body to said bore and is aligned with said first slot, said first leg comprising one tab which is adjacent said first distal end and said second leg comprising another tab which is adjacent said second distal end, and further in said first position, (a) said flange portion engages one area of said outer surface, and (b) said one tab and said another tab extend out of said bore and out of said second slot and are adapted for folding against another area of said outer surface to lock said connector body between (a) said flange portion and (b) said one tab and said another tab.

14. The grounding device of claim 13 wherein said flange portion is integral with a conductive connector shell, and further in said first position, said connector body extends into said conductive connector shell.

15. The grounding device of claim 14 wherein said first segment comprises a first projection extending towards said second segment, and further wherein said second segment comprises a second projection extending towards said first projection.

16. The grounding device of claim 15 wherein said base portion comprises a ground wire braid engaging third segment.

17. The grounding device of claim 16 wherein said first segment includes a first portion, and said second segment includes a second portion, said first portion being aligned along an axis with said second portion, and further wherein said third segment comprises a third projection which extends towards said axis.

18. A grounding device having at least one portion adapted for engagement with a ground wire braid of a coaxial cable, said ground wire braid having an outer diameter, said grounding device comprising at least one forked member comprising a base portion, a first leg extending from said base portion to a first distal end and a second leg extending from said base portion to a second distal end, said first leg having a ground wire braid engaging first segment and said second leg having a ground wire braid engaging second segment facing said first segment, at least a first portion of said first segment being spaced from at least a second portion of said second segment a distance no greater than said outer diameter, said first leg further comprising one tab which extends from said first distal end towards said first segment, and said second leg further comprising another tab which extends from said second distal end towards said second segment, said tabs being separated from said legs by fold lines.

19. The grounding device of claim 18 wherein said first segment comprises a first projection extending towards said second segment, and further wherein said second segment comprises a second projection extending towards said first projection, said first projection comprising said first portion and said second projection comprising said second portion.

* * * * *